US010495269B2

(12) United States Patent
Hikmet et al.

(10) Patent No.: US 10,495,269 B2
(45) Date of Patent: Dec. 3, 2019

(54) LIGHT EMITTING MODULE

(71) Applicant: SIGNIFY HOLDING B.V., Eindhoven (NL)

(72) Inventors: Rifat Ata Mustafa Hikmet, Eindhoven (NL); Albert Bijlsma, Best (NL); Ping Kian Bee, Singapore (SG); Durandus Kornelius Dijken, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 14/785,932

(22) PCT Filed: Dec. 23, 2014

(86) PCT No.: PCT/EP2014/079103
§ 371 (c)(1),
(2) Date: Oct. 21, 2015

(87) PCT Pub. No.: WO2015/101547
PCT Pub. Date: Jul. 9, 2015

(65) Prior Publication Data

US 2016/0312965 A1 Oct. 27, 2016

(30) Foreign Application Priority Data

Jan. 2, 2014 (EP) ..... 14150014
Jul. 10, 2014 (WO) ..... PCT/CN2014/082002

(51) Int. Cl.
*F21K 9/62* (2016.01)
*F21V 3/04* (2018.01)
(Continued)

(52) U.S. Cl.
CPC ..... *F21K 9/62* (2016.08); *F21K 9/232* (2016.08); *F21K 9/238* (2016.08); *F21V 3/02* (2013.01);
(Continued)

(58) Field of Classification Search
CPC . F21K 9/62; F21K 9/238; F21K 9/232; F21V 3/02; F21V 7/22; F21V 19/02;
(Continued)

(56) References Cited

U.S. PATENT DOCUMENTS 4,874,228 A * 10/1989 Aho ..... F21V 7/00 349/62
4,929,866 A * 5/1990 Murata ..... G02B 6/0036 313/500
(Continued)

FOREIGN PATENT DOCUMENTS

CN 101952646 A 1/2011
CN 102900978 A 1/2013
(Continued)

*Primary Examiner* — Anh T Mai
*Assistant Examiner* — Fatima N Farokhrooz
(74) *Attorney, Agent, or Firm* — Akarsh P. Belagodu

(57) ABSTRACT

The present invention relates to light emitting module, comprising: a mixing chamber (10) arranged to mix light, the mixing chamber (10) comprising a base (12) having a highly reflective inner surface, a circumferential side wall (14) having a highly reflective inner surface, and a semi-reflective light exit window (16); and at least one light emitting diode (5) arranged on the inner surface of the circumferential side wall (14) such that light emitted from the at least one light emitting diode (5) is emitted into the mixing chamber (10) for mixing of the emitted light within the mixing chamber (10), wherein the semi-reflective light exit window (16) is arranged to couple out light emitted from the at least one light emitting diode (5) and mixed within the mixing chamber (10), wherein the aspect ratio of a width (W) and a height (H) of the mixing chamber (10) is in the range of 1 to 8, wherein the reflectivity of the semi-reflective light exit window (16) is in the range from 30% to 80% for light emitted from the light emitting diode (5).

16 Claims, 6 Drawing Sheets

(51) Int. Cl.

| | |
|---|---|
| ***F21V 23/00*** | (2015.01) |
| ***F21K 9/238*** | (2016.01) |
| ***F21K 9/232*** | (2016.01) |
| ***F21V 3/02*** | (2006.01) |
| ***F21V 7/22*** | (2018.01) |
| ***F21V 19/02*** | (2006.01) |
| *F21S 6/00* | (2006.01) |
| *F21V 7/00* | (2006.01) |
| *F21V 7/04* | (2006.01) |
| *F21K 9/23* | (2016.01) |
| *F21Y 103/33* | (2016.01) |
| *F21Y 115/10* | (2016.01) |

(52) U.S. Cl.
CPC ..... *F21V 3/04* (2013.01); *F21V 7/22* (2013.01); *F21V 19/02* (2013.01); *F21V 23/005* (2013.01); *F21V 23/006* (2013.01); *F21K 9/23* (2016.08); *F21S 6/002* (2013.01); *F21V 7/0041* (2013.01); *F21V 7/043* (2013.01); *F21Y 2103/33* (2016.08); *F21Y 2115/10* (2016.08)

(58) Field of Classification Search
CPC ..... F21V 23/006; F21Y 2115/10; G02F 1/133603; G02F 1/133621; G02F 1/133615; G02F 1/133608; G02F 1/133605; G02F 2001/133626; G02B 6/0073; G02B 6/0068; G02B 6/0051; G02B 6/0046; G02B 6/0083; G09F 2013/1831; G09F 2013/1827
See application file for complete search history.

(56) References Cited

U.S. PATENT DOCUMENTS

| | | | | |
|---|---|---|---|---|
| 5,136,483 | A * | 8/1992 | Schoniger | F21S 45/37 362/545 |
| 5,570,384 | A | 10/1996 | Nishida et al. | |
| 6,409,361 | B1 * | 6/2002 | Ikeda | F21V 19/0025 362/240 |
| 7,029,152 | B1 * | 4/2006 | Kuhl | B60Q 1/26 362/140 |
| 9,159,521 | B1 * | 10/2015 | Chen | F21V 7/0025 |
| 2004/0156199 | A1 * | 8/2004 | Rivas | F21V 3/02 362/240 |
| 2005/0280756 | A1 * | 12/2005 | Kim | G02F 1/133603 349/114 |
| 2006/0109657 | A1 * | 5/2006 | Kuhl | B60Q 1/26 362/300 |
| 2006/0203468 | A1 | 9/2006 | Beeson et al. | |
| 2007/0047262 | A1 * | 3/2007 | Schardt | G02B 6/0055 362/623 |
| 2008/0247172 | A1 * | 10/2008 | Beeson | G02B 5/285 362/308 |
| 2010/0172152 | A1 * | 7/2010 | Boonekamp | F21V 7/0008 362/609 |
| 2010/0321919 | A1 * | 12/2010 | Yang | F21S 8/00 362/84 |
| 2011/0007506 | A1 * | 1/2011 | Kinoshita | G02B 6/0096 362/235 |
| 2011/0075410 | A1 * | 3/2011 | Negley | F21K 9/00 362/231 |
| 2011/0096529 | A1 | 4/2011 | Wheatley et al. | |
| 2011/0170289 | A1 * | 7/2011 | Allen | F21V 13/12 362/235 |
| 2011/0199352 | A1 * | 8/2011 | Wheatley | G02B 6/0035 345/207 |
| 2012/0020083 | A1 | 1/2012 | Tukker et al. | |
| 2012/0039073 | A1 | 2/2012 | Tong | |
| 2012/0105763 | A1 * | 5/2012 | Takeuchi | G02B 5/0236 349/61 |
| 2012/0206914 | A1 * | 8/2012 | Oza | F21V 7/00 362/235 |
| 2012/0212956 | A1 * | 8/2012 | Chen | F21V 7/005 362/235 |
| 2013/0063925 | A1 | 3/2013 | Boonekamp et al. | |
| 2013/0094177 | A1 * | 4/2013 | Edwards | F21K 9/64 362/84 |
| 2013/0141903 | A1 * | 6/2013 | Rivas | F21V 13/04 362/218 |
| 2015/0043206 | A1 * | 2/2015 | Donegan | F21V 29/004 362/235 |
| 2015/0138779 | A1 * | 5/2015 | Livesay | F21S 8/026 362/298 |

FOREIGN PATENT DOCUMENTS

| | | | |
|---|---|---|---|
| CN | 202927742 | U | 5/2013 |
| CN | 203036382 | U | 7/2013 |
| DE | 10201108673 | A1 | 5/2013 |
| JP | H06218565 | A | 8/1994 |
| JP | 2010097736 | A | 4/2010 |
| JP | 2011513897 | A | 4/2011 |
| JP | 2012531047 | A | 12/2012 |
| JP | 2013012422 | A | 1/2013 |
| JP | 2013064776 | A * | 4/2013 |
| JP | 2013145765 | A1 | 7/2013 |
| WO | WO2009105450 | A1 | 8/2009 |
| WO | 2013041979 | A1 | 3/2013 |
| WO | 2013168101 | A2 | 11/2013 |

* cited by examiner

LIGHT EMITTING MODULE

CROSS-REFERENCE TO PRIOR APPLICATIONS

This application is the U.S. National Phase application under 35 U.S.C. § 371 of International Application No. PCT/EP2014/079103, filed on Dec. 23, 2014, which claims the benefit of European Patent Application No. EP 14150014.0, filed on Jan. 2, 2014 and International Application No. PCT/CN2014/082002, filed Jul. 10, 2014. These applications are hereby incorporated by reference herein.

FIELD OF THE INVENTION

The invention relates to a light emitting module which comprises a light mixing chamber and least one light emitting diode. The invention further relates to a lamp and a luminaire comprising such a light emitting module.

BACKGROUND OF THE INVENTION

The field of light emitting modules includes a large variety of different light emitting modules regarding use light sources, construction, optical characteristics, etc. Important characteristics for many applications of light emitting modules are that they shall be arranged to provide uniform illumination. Another important aspect of light emitting modules is the increasing need of providing energy efficient light emitting modules. One example of light emitting modules being energy efficient is light emitting modules being based on LEDs. However, LEDs are point sources and hence there is a problem of producing LED based light emitting modules providing uniform illumination.

In order to obtain uniform light various strategies have been adopted. One of the strategies is based on the use of solid wave guides with out-coupling structures. However, such wave guides can absorb light and coupling light into a solid wave guide can give losses. Another strategy is placing large number of LEDs at the bottom of a mixing chamber in combination with a diffuser for obtaining uniform illumination. However, placing LEDs at the bottom surface can decrease the reflectivity and thus reduced system efficiency. Furthermore placing large number of LEDs at the bottom of a mixing chamber is costly and it can also lead to excess heating due to the concentration of LEDs to a small area.

Hence, there is a need for alternative light emitting modules being able to provide uniform illumination.

SUMMARY OF THE INVENTION

It is an object of the present invention to overcome the above mentioned problems, and to provide a light emitting module being able to provide uniform illumination in an efficient and cost effective manner.

According to a first aspect of the invention, this and other objects are achieved by a light emitting module, comprising: a mixing chamber arranged to mix light, the mixing chamber comprising a base having a highly reflective inner surface, a circumferential side wall having a highly reflective inner surface, and a semi-reflective light exit window; and at least one light emitting diode arranged on the inner surface of the circumferential side wall such that light emitted from the at least one light emitting diode is emitted into the mixing chamber for mixing of the emitted light within the mixing chamber, wherein the semi-reflective light exit window is arranged to couple out light emitted from the at least one light emitting diode and mixed within the mixing chamber, wherein the aspect ratio of a width and a height of the mixing chamber is in the range of 1 to 8, wherein the reflectivity of the semi-reflective light exit window is in the range from 30% to 80% for light emitted from the light emitting diode.

The present invention is aimed at providing an efficient LED based light emitting module which provides uniform illumination. This is achieved by providing the light emitting module with a mixing chamber comprising highly reflective base and side walls and a semi-reflective light exit window and arranging at least one light emitting diode(s), LED(s), at the side wall for emitting light into the mixing chamber from the sides of the mixing chamber. By not directing the at least one LED towards the exit window, but instead towards the opposite part of the side circumferential side wall, an improved light mixing within the mixing chamber may be achieved. Moreover, since both the side wall and the base of the mixing chamber is highly reflective, almost all of the light emitted towards the side wall and the base will be reflected and eventually be coupled out from the semi-reflective light exit window. Since the light exit window is semi-reflective, some of the light incident on this surface will be reflected back into the mixing chamber, to be further reflected by the side surface and/or the base of the mixing chamber before being coupled out from the light exit window, and thus improving the light mixing within the mixing chamber.

An important parameter of the mixing chamber in order for the light emitting module to achieve optimum efficiency and at the same time acceptable uniformity, i.e. light mixing within the mixing chamber, of the illumination provided by the light emitting module is the aspect ratio between the width and the height of the mixing chamber. The width relates to a diameter of the circumferential side wall and the height relates to the size of the side wall, i.e. the height of the side wall. The higher the mixing chamber is, the farther away from the light exit window the at least one LED may be positioned which means that the risk for high intensity spots in light coupled out from the light mixing window is decreased. At the same time, the wider the mixing chamber is, the larger is the risk that light cannot be mixed evenly along the entire surface of the light exit window. On the other hand, the farther away from the light mixing window the at least on LED is positioned, the lower is the efficiency of light coupled out from the light mixing window. Another important parameter is the reflectivity of the semi-reflective light exit window as described above. The inventors have found that by arranging the aspect ratio between the width and the height of the mixing chamber in the range from 1 to 8 while and at the same time arranging the reflectivity of the semi-reflective light exit window in the range from 30-80%, an increased efficiency and at the same time an acceptable uniformity of the illumination coupled out from the light emitting module may be achieved, which will be explained in detail below. The above characteristics for the mixing chamber may provide an efficient light mixing within the mixing chamber and an efficient out coupling of light from the mixing chamber. Hence, the light emitting module according to the present invention may provide uniform illumination in an efficient manner. A further effect of this may be that the number of LEDs needed in a light emitting module for producing light with a certain lux may be decreased which is advantageous for cost reasons.

According to an embodiment, the absorbance, for light emitted from the light emitting diode, of the semi-reflective light exit window is less than 2%. Thus the efficiency of the light emitting module may be further improved.

According to another embodiment, the at least one light emitting diode is arranged adjacent to the base. As described above, this may cause the uniformity of light coupled out from the light exit window to increase since the distance from the at least one light emitting diode to the light exit window is increased.

According to an embodiment, the term "highly reflective" means reflective in the range from 90-100% for light emitted from the light emitting diode. This may be advantageous for increasing the light mixing and also for increasing the efficiency of light coupled out from the light emitting module.

According to yet another embodiment, the mixing chamber is cylindrical. This exemplary design of the mixing chamber may simplify the manufacturing process of the light emitting module. The shape of the cylinder may be a right circular cylinder but it may also be shaped as an ellipse in the sense that the base and a cross section, taken in a plane being parallel with the base, of the circumferential side wall are shaped as an ellipse. The shape of the mixing chamber is advantageously designed in view of the application for the light emitting module, e.g. for retrofitting reasons. The cross-section of the mixing chamber may also have other shapes such as rectangle, square, hexagon etc.

According to an embodiment, the light exit window is diffusive. This may be advantageous for reducing glare for the light emitting module.

According to some embodiment, the inner surface of the base is planar. According to other embodiments, the inner surface of the base is curved and/or having a domed shape. According to some embodiment, the light exit window is planar. According to other embodiments, the light exit window is curved and/or having a domed shape. The shape of the base and the light exit window may influence and improve the uniformity of the illumination coupled out from the light emitting module. For example, if the light exit window is curved and/or having a domed shape (e.g. that the center of the light exit window is lcm higher in the z-direction compared to the outer edges of the light exit window), this may have a positive effect on the homogeneity of light coupled out from the light exit window. The curved and/or dome shaped exit window may be used if the height of the mixing chamber is too small or if ratio between the width and the height of the mixing chamber is too large to obtain a uniform illumination with a planar light exit window. In this case the shape of the light exit window may be changed in order to obtain a uniform illumination.

According to some embodiments, the light emitting module further comprises a reflective structure. The reflective structure may be arranged at the base. This provide for an increased light mixing in the mixing chamber.

According to an embodiment, the at least one light emitting diode is arranged on a flexible strip. This provides for an easy assembly of the at least one light emitting diode on the side wall of the mixing chamber. In a further embodiment the strip is highly reflective. Optionally additional electronic components and/or electrical wiring are arranged on the flexible strip.

According to an embodiment, the mixing chamber is ring shaped and comprises an inner wall having a highly reflective surface facing the at least one light emitting diode. In this way a different uniform light output profile is provided. In a further embodiment one or more electronic components are arranged inside the cavity that is defined by the inner wall, providing for a compact light emitting device. In an embodiment the inner wall is defined by a recess in the base of the mixing chamber. This provides for a simple fabrication of the mixing chamber by using, for example, a standard stamping technique to shape the mixing chamber.

According to an embodiment, the light emitting device further comprises electronic components that are arranged on the base of the mixing chamber. For example, a driver electronic circuit, one or more sensors, and/or a battery are arranged on the base. In an embodiment a highly reflective foil covers the one or more electronic components. Alternatively, the electronic components are provided with a highly reflective material, such as white paint.

According to an embodiment, the light emitting device further comprises a cavity between the base and a reflective foil in which one or more electronic components are arranged. This cavity, or space, where the one or more electronic components are arranged, results in a compact light emitting device. In an embodiment the cavity is a protrusion that extends from the base. In another embodiment the cavity extends over the whole diameter or width of the mixing chamber, and is realized by an increased height of the mixing chamber.

According to a second aspect, the present invention provides a lamp comprising a light emitting module according to the first aspect of the present invention.

According to a third aspect, the present invention provides a luminaire comprising a light emitting module according to the first aspect of the present invention or a lamp according to the second aspect of the present invention.

The second and third aspect may generally have the same features and advantages as the first aspect.

It is noted that the invention relates to all possible combinations of features recited in the claims. Generally, all terms used in the claims are to be interpreted according to their ordinary meaning in the technical field unless explicitly defined otherwise herein.

Other objectives, features and advantages of the present invention will appear from the following detailed disclosure as well as from the drawings.

BRIEF DESCRIPTION OF THE DRAWINGS

This and other aspects of the present invention will now be described in more detail, with reference to the appended drawings showing embodiments of the invention, wherein.

DETAILED DESCRIPTION

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1:
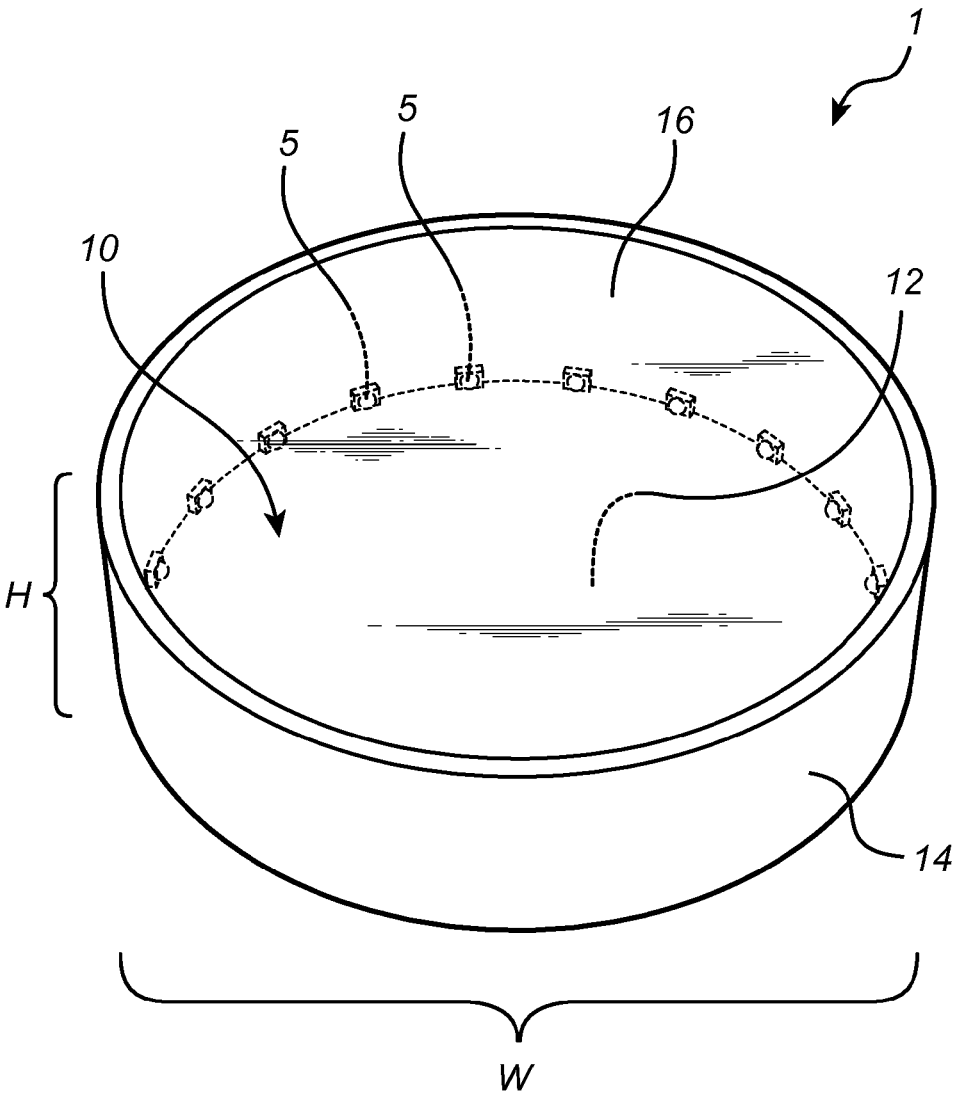
FIG. 1 schematically illustrates a light emitting module according to embodiments.

In FIG. 1 an embodiment of a light emitting module 1 according to the present invention is schematically shown. The light emitting module 1 comprises a mixing chamber 10 and a plurality of light emitting diodes, LEDs, 5.

The mixing chamber 10 comprising a base 12, a circumferential side wall 14 and a light exit window 16. In the embodiment shown in FIG. 1 the mixing chamber 10 is having a cylindrical shape. Moreover, the base 12 and the light exit window 16 are oval, more precisely they are circular. Furthermore, the cross section, taken in a plane being parallel with the base 12, of the circumferential side wall 14 is also oval, more precisely circular.

The mixing chamber 10 has a width W and a height H. The height H of the mixing chamber 10 is defined as the height of the circumferential side wall 14. This height H of the mixing chamber 10 for the embodiment shown in FIG. 1 might also be seen as the distance between the base 12 and the light exit window 16. The width W of the mixing chamber 10 is defined as having a base surface extension being the smallest distance between two opposite points on the periphery of the base surface. In the embodiment shown in FIG. 1 the width W of the mixing chamber 10 is the diameter of the base 12. As mentioned above, an aspect ratio of the width W and the height H of the mixing chamber 10 within the range of 1 to 8 may increase the light mixing of the light mixing module 1 while the efficiency of the light mixing module 1 is not lowered beyond what is acceptable. Tests have been performed evaluating the efficiency and the uniformity of light coupled out from the light emitting module depending on the aspect ratio. These tests has been performed with a mixing chamber 10 with a width W of 150 mm, in this cylindrical example the width is the diameter, where the reflectivity of the light exit window 16 is kept at 50% and where the height H of the mixing chamber 10 is varied between 10 mm and 50 mm, the LEDs 5 being placed adjacent to the base 12 which is means that the distance from the centre of the LEDs to the inner surface of the base 12 is 5 mm. The inner surface of the base 12 and the light exit window are planar. The tests show that the contrast, which is the ratio of highest intensity and lowest intensity, which means that a lower contrast corresponds to a more uniform illumination, of the light emitted from the light emitting module 1 is rapidly decreasing from 18 to 2 when the height H is increased from 10 mm to 20 mm (i.e. the aspect ratio is decreased from 15 to 7.5). When the height H is increased from 20 to 45, the contrast is decreased from 2.0 to 1.7. Moreover, the tests show that the efficiency is more or less linearly decreased from 96.0% to 94.5% when the height is increased from 15 mm to 50 mm.

The base 12 has a highly reflective inner surface. Highly reflective is to be seen as having a reflectivity in the range of 90%-100% for light emitted by the plurality of LEDs 5. Moreover, the absorbance of the base 12 is close to zero for light emitted from the plurality of LEDs 5. Having an absorbance close to zero gives that the efficiency of the light emitting module is kept high. The base 12 may be made of metal or glass, and the base 12 may either be covered by a sheet of reflecting material or be painted with a coating reflector. The sheet of reflecting material may be MCPET foil manufactured by Furukawa Electric. The coating reflector may be for example TiO2 powder particles mixed with clear silicone. Instead of TiO2 powder, Al2O3 and/or BaSO4 powder may be used and mixed with clear silicone.

The circumferential side wall 14 has a highly reflective inner surface. Highly reflective is to be seen as having a reflectivity in the range of 90%-100% for light emitted by the plurality of LEDs 5. Moreover, the absorbance of the circumferential side wall 14 is close to zero for light emitted from the plurality of LEDs 5. Having an absorbance close to zero gives that the efficiency of the light emitting module is kept high. It was proposed to use a wide printed circuit board (PCB), covering the whole circumferential side wall 14 of the light emitting module 1 (so the width of the PCB is the same as the height of the circumferential side wall 14). According to other embodiments, the lower part of the circumferential side wall 14 is made of a PCB and the remaining part is made of metal or glass. The circumferential side wall 14 may be covered by a sheet of reflecting material or may be painted with a coating reflector in the same way as the inner surface of the base 12. In the case of using a sheet of reflecting material, there should be holes in the material where the LEDs 5 are positioned. The mixing chamber 10, i.e. the base 12 and the circumferential side wall 14 may be manufactured to be as white as possible. This may minimize light absorption in the mixing chamber and the efficiency of the light emitting module 1. The light exit window 16 is semi-reflective. More specifically, the reflectivity of the light exit window 16 is in the range of 30%-80% for light emitted from the plurality of LEDs 5. The absorbance of the light exit window 16 is preferably less than 2% for light emitted from the plurality of LEDs 5. By having such a low absorbance in the light exit window 16 gives that the efficiency of the light emitting module 1 is kept high. As a non-limiting example the light exit window 16 may be made of Makrofol®. However, other material such as Lexan® MB-grades, Lexalite Lumieo® and Flexi-Lume™ may also be used. It is also possible to use layers of scattering particles such as TiOx or AlOx in polymers such as silicone rubbers and adjust the reflectivity by the concentration of the particles and/or the thickness of the layer.

The light exit window 16 may also comprise beams shaping optics, such as a diffuser and/or a layer with structures for polarizing and/or collimating light. Such layers can have microstructures for collimating light and/or shaping the beam. Examples of such layers are BEF (brightness enhancement film) and reflective polarizing films available from companies such as 3M.

According to tests evaluating the efficiency of the light emitting module 1 depending on the reflectivity of the light exit window 16, the efficiency decreases from around 92% to 75% when the reflectivity increases from 80% to 90%. For reflectivity below 80%, the efficiency increases from 92% to 97% for a reflectivity of 20%.

Depending on the wavelength range of the light emitted from the LEDs 5 the light exit window 16 may further comprise luminescent material. The luminescent material converts at least a part of light of a first color which impinges on the luminescent material into light of a second color.

The plurality of LEDs 5 are arranged on the inner surface of the circumferential side wall 14 such that light emitted from the at least one light emitting diode 5 is emitted into the mixing chamber 10 for mixing of the emitted light within the mixing chamber 10. The LEDs 5 are furthermore preferably placed adjacent to or near the base 12 as explained below, which according to some embodiments means that the distance from the centre of the LEDs 5 to the inner surface of the base 12 is 5 mm. This is of course dependent on the size of the LEDs 5. According to further embodiments, the position of the LEDs 5 relative to the base 12 is larger. In an embodiment the plurality of LEDs are arranged on a flexible strip and the strip is mounted on the inner surface of the side wall of the light mixing chamber. The strip is in an embodiment highly reflective. In another embodiment one or more electronic components are additionally provided on the reflective and flexible strip, such as driver electronics and electrical wiring.

The plurality of LEDs 5 may be arranged to emit light in a wide range of wavelengths. For example each of the LEDs 5 may be arranged to emit white light. According to another example various LEDs 5 may be arranged to emit light of a specific color. For example, at least one of the plurality of LEDs 5 may be arranged to emit red light, at least one of the plurality of LEDs 5 may be arranged to emit green light and at least one of the plurality of LEDs 5 may be arranged to emit blue light. The light emitted from these LEDs 5 will thereafter mix inside the mixing chamber 10 producing white light. According to another example the LEDs 5 may be arranged to emit blue light and, if so, the light exit window 16 preferably comprises luminescent material converting a part of the blue light impinging on the luminescent material into light of another color. By this the light emitted from the light emitting module will for example be seen as white light.

Figure 2:
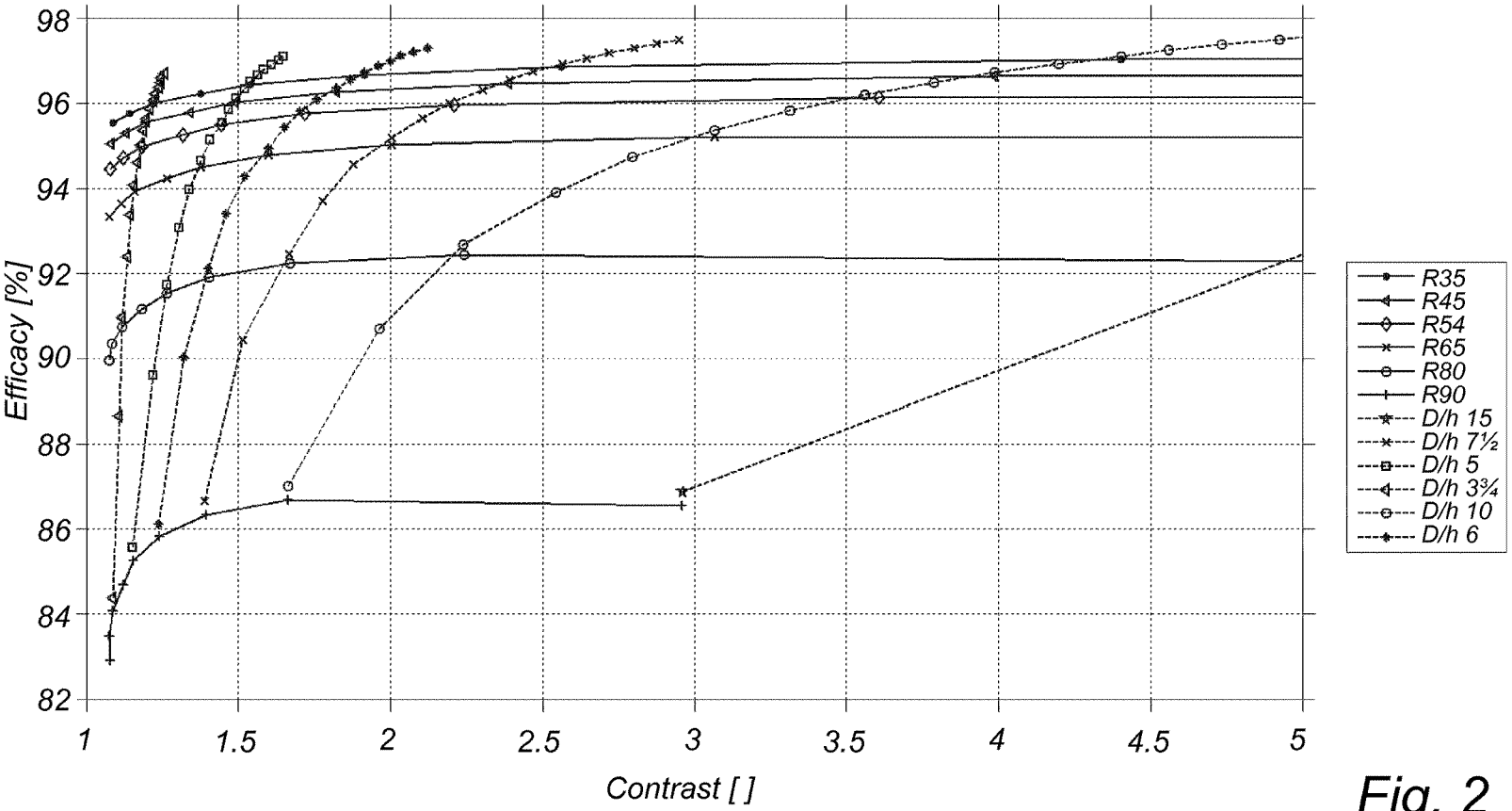
FIG. 2 illustrates simulations of efficiency plotted as a function of uniformity depending on different reflectivity of the light exit window and different aspect ratios of the width and height of the mixing chamber.

In FIG. 2 simulations of efficiency are plotted as a function of uniformity, in the graph the uniformity is represented as the contrast, defined as the ratio of the highest intensity and lowest intensity as described above, of the light emitted from the light emitting module, for various mixing chamber 10 width W and height H aspect ratios, W/H (in the Figure indicates as D/h), and for light exit windows 16 with various reflectivity. The simulations are made for cylindrical light emitting modules 1 having a circular base 12 and a circular light exit window 16. Moreover, the absorbance of the semi-reflective light exit window 16 was set to be 2%. Furthermore the plurality of LEDs 5 was placed adjacent to the base 12.

Each dotted line represents a certain aspect ratio. Each dotted line is plotted showing the contrast versus the efficiency when the reflectivity of the light exit window 16 is increased in steps of 5 from 10% to 90%. As can be understood from the above, a lower reflectivity results in a higher efficiency and a higher contrast (i.e. a lower uniformity). Consequently, the value of each dotted line having the highest efficiency represents the lowest reflectivity of the light exit window 16.

Each solid line represents a certain reflectivity of the light exit window 16. Each line is plotted showing the contrast versus the efficiency when the height H of the mixing chamber 10 is varied from 10 mm to 50 mm in steps of 5 mm whilst the width W is kept at 150 mm. As can be understood from the above, a smaller height H results in a higher contrast and a higher efficiency. Consequently, the right most value of each solid line represents the smallest height H of the light mixing chamber 10.

From FIG. 2 it can be concluded that optimum situation with regard to efficiency and uniformity is achieved with the aspect ratio in the range of 1 to 8 while the reflectivity of the semi-reflective light exit window 16 is in the range of 30% to 80%.

Figure 3:
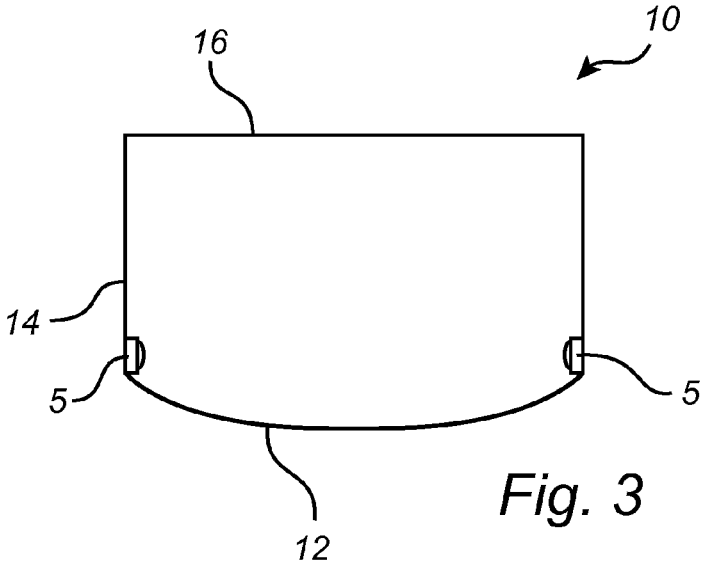
FIGS. 3-5 illustrate by way of example different configurations of the light mixing chamber seen in cross section from the side.

FIG. 3 shows by way of example a light mixing chamber 10 seen in cross section from the side. The light mixing chamber 10 in FIG. 3 has a planar light exit window 16 and a curved base 12.

Figure 4:
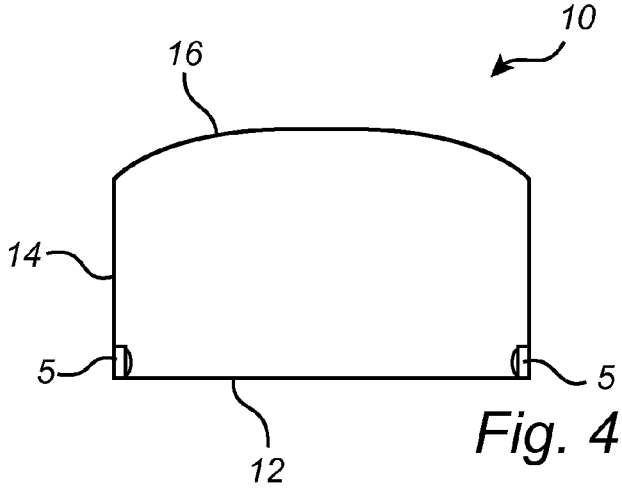

FIG. 4 shows by way of example a light mixing chamber 10 seen in cross section from the side. The light mixing chamber 10 in FIG. 4 has a curved light exit window 16 and a planar base 12. As mentioned above, the shape of the light exit window 16 and the base 12 may influence the uniformity of light coupled out from the light exit window 16.

Figure 5:
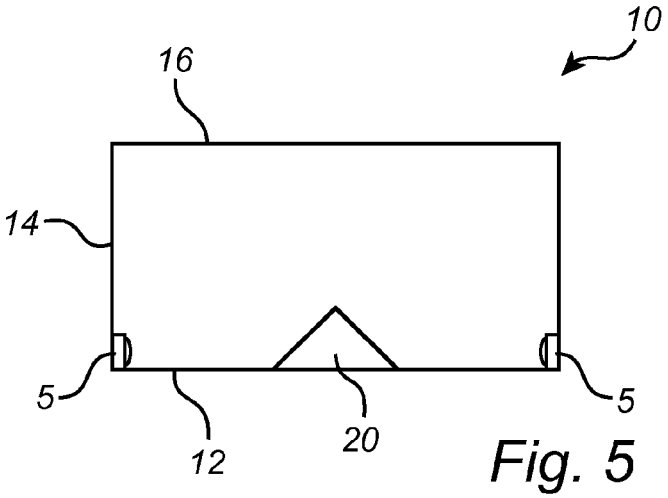

FIG. 5 shows by way of example a light mixing chamber 10 seen in cross section from the side. This light mixing chamber 10 is similar to the one shown in FIG. 1. The difference is that a reflective structure 20 has been arranged at the base 12 of the light mixing chamber 10. The light mixing chamber 10 may of course contain any number of such a reflective structure 20. In that case, the reflective structures 20 may be differently shaped. The reflective structure may also be arranged at the side wall 14. The reflective structure 20 may be in the form of facets. The reflective structure 20 may also be in the form of surface roughness i.e. a texture of the surface. Any other suitable structures may be used. By adding a reflective structure to the light mixing chamber 10, the light mixing properties of the chamber 10 may be further improved.

Figure 6:
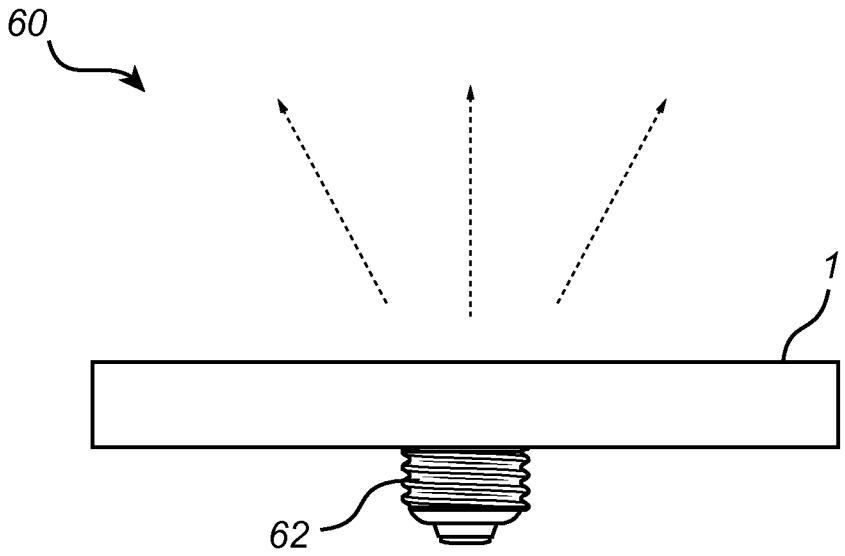
FIG. 6 illustrates a lamp according to embodiments.

FIG. 6 shows an embodiment of a retrofit lamp 60 based on the above described concept. The lamp 60 comprises a retrofit fitting, or lamp base, 62 which includes a heat sink, a power driver and electrical connections. On the lamp base 62 is provided a light emitting module 1 according to the first aspect of the invention. It is to be noted that embodiments of the lamp are not limited to lamps that are shaped as in FIG. 6. Other shapes, like tube or a traditional light bulb, are possible as well. Moreover, the light emitting module 1 may be a part of a larger structure provided on the lamp base 62. Alternative lamp types, such a spot lamps or down lighter may be used as well. The lamps may comprise a plurality of light emitting modules 1 as well.

Figure 7:
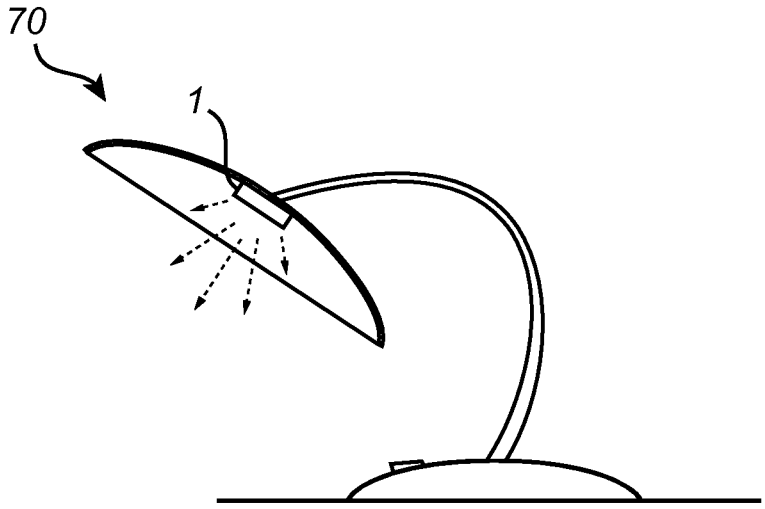
FIG. 7 illustrates a luminaire according to embodiments.

FIG. 7 shows an embodiment of a luminaire 70 according to the third aspect of the invention. The luminaire 70 comprises a light emitting module 1 according to the first aspect of the invention. In other embodiments, the luminaire 70 comprises a lamp (reference 60 in FIG. 6) according to the second aspect of the invention.

Figure 8:
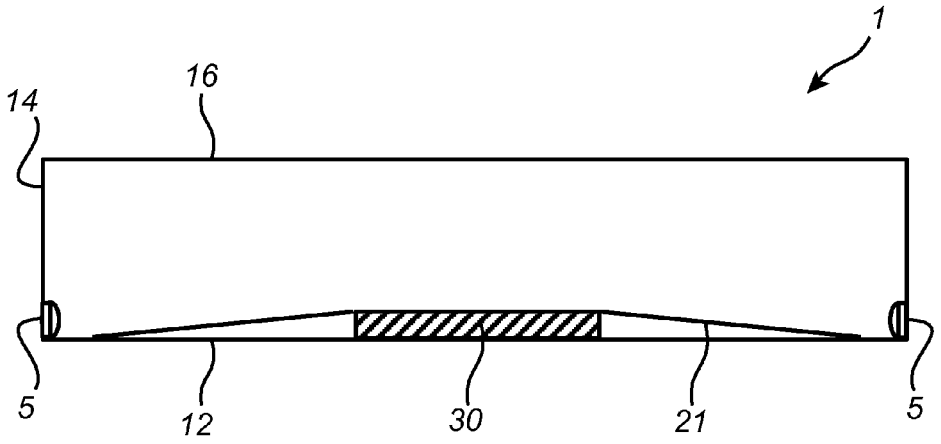
FIGS. 8-10 illustrate by way of example different configurations of the light emitting module with a light mixing chamber seen in cross section from the side, As illustrated in the figures, the sizes of layers and regions are exaggerated for illustrative purposes and, thus, are provided to illustrate the general structures of embodiments of the present invention. Like reference numerals refer to like elements throughout.

FIG. 8 shows an embodiment of a light emitting module 1 with a light mixing chamber seen in cross section from the side. In this embodiment, one or more electronic components 30 are provided on the base 12 of the light mixing chamber, such as for example driver electronics, an electrical converter, a sensor (e.g. remote control sensor, light sensitive sensor, a motion sensor), a battery, etc. In this embodiment a light reflective foil 21 covers the one or more electronic components 30, but in other embodiments the light reflective foil 21 is not present and in that case the one or more electronic components 30 may be highly reflective, for example by using white paint.

Figure 9:
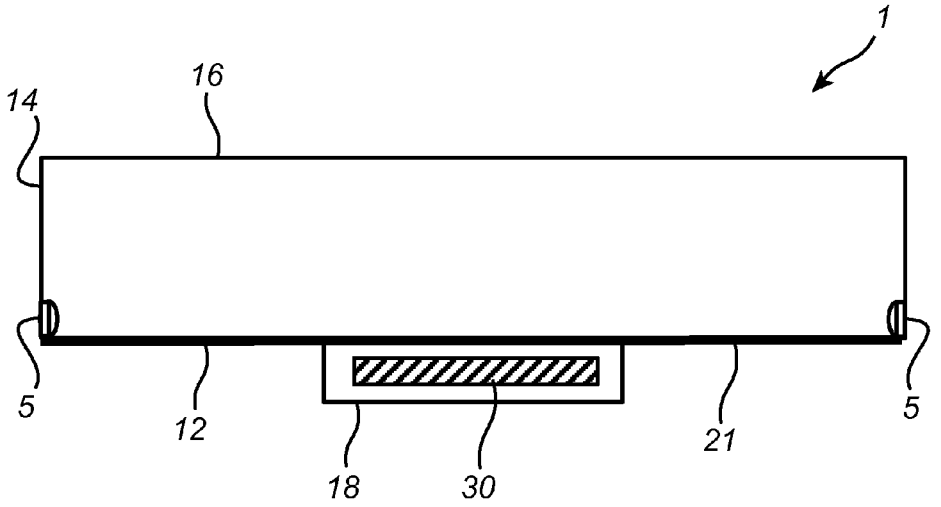

FIG. 9 shows an embodiment of a light emitting module 1 with a light mixing chamber seen in cross section from the side. In this embodiment the light mixing chamber comprises a cavity 18 in the form of a protrusion extending from the base 12, in which one or more electronic components 30 are placed, examples of such components being specified above. A reflective foil 21 is provided to cover the one or more electronic components 30 that are placed in the chamber or protrusion 18. In an embodiment the reflective foil 21 may extend over the entire base 12. The cavity or protrusion 18 may fit easily in a junction box.

In an embodiment (not shown) the light mixing chamber is increased in height and the one or more electronic components 30 are provided on the base 12 of the light mixing chamber and are covered by a reflective foil 21 that extends between the side walls 14 over the whole diameter or width of the light mixing chamber. The increased height provides a housing or cavity between the base 12 and the reflective foil 21 for the one or more electronic components 30.

In an embodiment (not shown) one or more electronic components 30 are provided externally and adjacent to the side wall 14 of the light mixing chamber. In this embodiment a hollow space is provided outside the side wall 14 of the light mixing chamber in which the one or more electronic components 30 are mounted.

Figure 10:
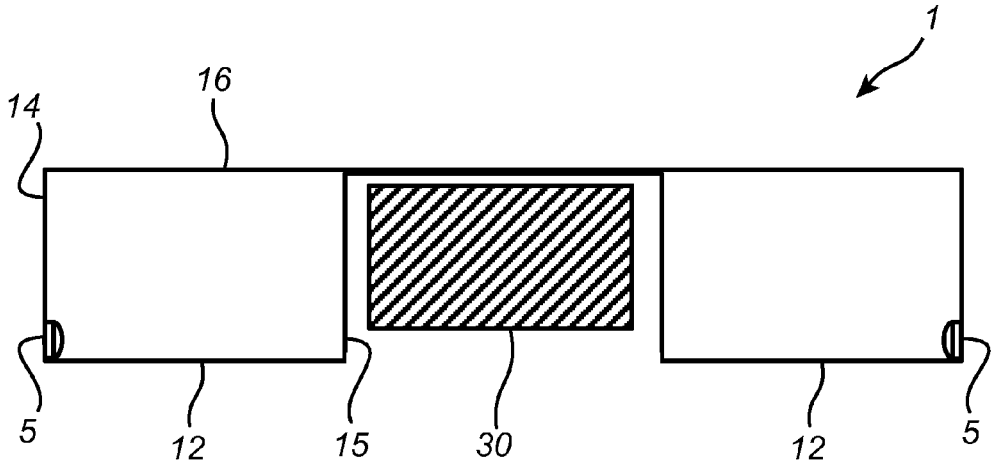

FIG. 10 shows an embodiment of a light emitting module 1 with a light mixing chamber seen in cross section from the side. In this embodiment the light mixing chamber is ring shaped and comprises an inner wall 15 that defines a chamber or housing, in the form of a recess of the base 12, in which one or more electronic components 30 are provided, for example mounted on the base 12 of the light mixing chamber. In this embodiment the light output of the light emitting module 1 is ring-shaped. The inner wall 15 has a highly reflective inner surface, which is the surface that faces the light emitting diodes 5.

The person skilled in the art realizes that the present invention by no means is limited to the preferred embodiments described above. On the contrary, many modifications and variations are possible within the scope of the appended claims. For example, the shape of the base is disclosed as being circular or ellipsoid, but other shapes of the base are equally possible. The base may for example be shaped as a square, a hexagon or a triangle. This is equally valid for the cross section of the side wall. Moreover, the base and the cross section of the side wall may be differently shaped.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. A light emitting module, comprising:

a mixing chamber arranged to mix light, the mixing chamber being defined by a base having a highly reflective inner surface, a circumferential side wall having a highly reflective inner surface, and a semi-reflective light exit window, wherein the highly reflective inner surface of the base has a periphery; and at least one light emitting diode arranged on an inner surface of the circumferential side wall and at the periphery of the base, the at least one light emitting diode facing the circumferential side wall such that light emitted from the at least one light emitting diode is emitted into the mixing chamber for mixing of the emitted light within the mixing chamber and light is emitted from the at least one light emitting diode to the base and the circumferential side wall, wherein the semi-reflective light exit window is arranged to couple out light emitted from the at least one light emitting diode and mixed within the mixing chamber, wherein the aspect ratio of a width and a height of the mixing chamber is in the range of 1 to 8 and the height represents an approximate distance between the at least one light emitting diode and the semi-reflective light exit window, and the reflectivity of the semi-reflective light exit window is in the range from 30 to 80% for light emitted from the light emitting diode, to increase the light mixing while the efficiency is not lowered, and wherein the at least one light emitting diode is arranged on a flexible strip mounted on the inner surface of the circumferential side wall.

2. The light emitting module according to claim 1, wherein the absorbance, for light emitted from the light emitting diode, of the semi-reflective light exit window is less than 2%.

3. The light emitting module according to claim 1, wherein the at least one light emitting diode is arranged adjacent to the base.

4. The light emitting module according to claim 1, wherein highly reflective is reflective in the range from 90%-100% for light emitted from the light emitting diode.

5. The light emitting module according to claim 1, wherein the base and a cross section, taken in a plane being parallel with the base, of the circumferential side wall are shaped as one of a circle, an ellipse, a rectangle and a hexagon.

6. The light emitting module according to claim 1, wherein the light exit window is diffusive.

7. The light emitting module according to claim 1, wherein the light exit window is curved and/or having a domed shape.

8. The light emitting module according to claim 1, wherein the light emitting module further comprises a reflective structure.

9. The light emitting module according to claim 1, wherein the mixing chamber is ring shaped and comprises an inner wall having a highly reflective surface facing the at least one light emitting diode.

10. The light emitting module according to claim 1, further comprising electronic components arranged on the base.

11. The light emitting module according to claim 1, further comprising a cavity between the base and a reflective foil in which one or more electronic components are arranged.

12. A lamp comprising a light emitting module according to claim 1.

13. A luminaire comprising a light emitting module according to claim 1.

14. The light emitting module according to claim 8, wherein the reflective structure is arranged at the base.

15. A luminaire comprising a light emitting module comprising a lamp according to claim 12.

16. A light emitting module, comprising:

a mixing chamber arranged to mix light, the mixing chamber being defined by a base having a highly reflective inner surface, a circumferential side wall having a highly reflective inner surface, and a semi-reflective light exit window, wherein the highly reflective inner surface of the base has a periphery; and at least one light emitting diode arranged on an inner surface of the circumferential side wall and proximate the periphery of the base, a center of the at least one light emitting diode is arranged a distance from the highly reflective inner surface of the base where the distance is smaller than a size of the at least one light emitting diode, the at least one light emitting diode facing the circumferential side wall such that light emitted from the at least one light emitting diode is emitted into the mixing chamber for mixing of the emitted light within the mixing chamber and light is emitted from the at least one light emitting diode to the base and the circumferential side wall, wherein the semi-reflective light exit window is arranged to couple out light emitted from the at least one light emitting diode and mixed within the mixing chamber, wherein the aspect ratio of a width and a height of the mixing chamber is in the range of 1 to 8 and the height represents an approximate distance between the at least one light emitting diode and the semi-reflective light exit window, and the reflectivity of the semi-reflective light exit window is in the range from 30 to 80% for light emitted from the light emitting diode, to increase the light mixing while the efficiency is not lowered, and wherein the at least one light emitting diode is arranged on a flexible strip mounted on the inner surface of the circumferential side wall.

* * * * *